US005331833A

United States Patent [19]

Heitze

[11] Patent Number: 5,331,833

[45] Date of Patent: Jul. 26, 1994

[54] METHOD OF OPERATING AN UPSETTING PRESS

[75] Inventor: Gerhard Heitze, Netphen, Fed. Rep. of Germany

[73] Assignee: SMS Schloemann-Siemag Aktiengesellschaft, Düsseldorf, Fed. Rep. of Germany

[21] Appl. No.: 844,252

[22] Filed: Mar. 2, 1993

[30] Foreign Application Priority Data

Mar. 1, 1991 [DE] Fed. Rep. of Germany ..... 4106490

[51] Int. Cl.[5] ..... B21B 15/00; B65H 20/00; B21J 9/02

[52] U.S. Cl. ..... 72/184; 72/206; 72/421; 164/476; 226/178

[58] Field of Search ..... 72/21, 24, 184, 206, 72/251, 419, 420, 421; 29/527.7; 164/155, 476; 226/29, 30, 178

[56] References Cited

U.S. PATENT DOCUMENTS

| | | | |
|---|---|---|---|
| 3,080,782 | 3/1963 | Socke | 226/178 |
| 3,263,884 | 8/1966 | Doerfling | 226/30 |
| 4,078,416 | 3/1978 | Voorhees et al. | 226/178 |
| 4,653,311 | 3/1987 | Tack, Jr. | 72/21 |

FOREIGN PATENT DOCUMENTS

| | | | |
|---|---|---|---|
| 0112516A2 | 7/1984 | European Pat. Off. . | |
| 0270245A2 | 6/1988 | European Pat. Off. . | |
| 0157575B1 | 5/1990 | European Pat. Off. . | |
| 0368333 | 5/1990 | European Pat. Off. | 72/206 |
| 0400385A3 | 12/1990 | European Pat. Off. . | |
| 92102140 | 7/1992 | European Pat. Off. . | |
| 2531591A1 | 2/1977 | Fed. Rep. of Germany . | |
| 3837643 | 5/1990 | Fed. Rep. of Germany | 72/184 |
| 3900668A1 | 7/1990 | Fed. Rep. of Germany . | |
| 0121001 | 6/1985 | Japan | 72/206 |

*Primary Examiner*—Lowell A. Larson
*Assistant Examiner*—Thomas C. Schoeffler
*Attorney, Agent, or Firm*—Anderson Kill Olick & Oshinsky

[57] ABSTRACT

A method of operating an upsetting press for reducing the width of a hot slab cast in a continuous casting plant by laterally pressing the slab between the pressing tools of the upsetting press which are moved toward each other and away from each other by an eccentric lifting member as the slab moves on a roller conveyor through the upsetting press. During the time phase in which the pressing tools have no contact with the slab, the slab is accelerated from a predetermined feeding speed and is subsequently decelerated to this predetermined feeding speed, reducing the upsetting of the slab.

5 Claims, 2 Drawing Sheets

METHOD OF OPERATING AN UPSETTING PRESS

BACKGROUND OF THE INVENTION

1. Field of the Invention

The present invention relates to a method of operating an upsetting press for reducing the width of a hot slab cast in a continuous casting plant by laterally pressing the slab between the pressing tools of the upsetting press which are moved toward each other and away from each other by means of an eccentric lifting member as the slab moves on a roller conveyor through the upsetting press.

2. Description of the Related Art

Upsetting presses for reducing the width of continuously cast slabs are known. They are used in order to be able to carry out a rolling schedule which is as varied as possible with the smallest number of slab widths as possible. It has been found that the adjustment of adjustable molds in continuous casting plants for manufacturing slabs of differing widths is too slow and too complicated. It has further been found that the lateral upsetting of a hot continuously cast slab between the rolls of heavy vertical stands in many cases does not lead to the expected success because for technological reasons the slab material bulges in the edge region during edging rolling, and during flat rolling tongue-like portions are formed at the front end of the rolled strip and fishtail-like portions are formed at the end of the strip.

The lateral upsetting of a hot slab between the pressing tools of an upsetting press has the advantage that the slab material is upset far to the center of the slab, so that edge bulges occurring during edging rolling are almost completely eliminated and the formation of fishtail-like portions at the slab ends and, thus, also at the ends of the hot-rolled strip, is significantly reduced as compared to edging rolling in a vertical stand. As a result, the slabs upset in the upsetting press have an almost rectangular cross-section. Since the slab ends are well-formed and the slab cross-section is also well-formed, there is a smaller amount of hot top discard in the subsequent rolling mill train than in the past. This increases the yield of the entire rolling plant. In addition, because of the relatively long length of engagement of the pressing tools, upsetting ensures slab edges which are shaped in an optimum manner. For example, by means of an upsetting press known from European patent application 0 400 385 A2, the width of a hot continuously cast slab could be reduced in one pass by up to 300 mm. In other words, the upsetting press represents a highly effective deformation stage in front of the hot rolling mill.

The upsetting press for reducing the width of rolled material, particularly for reducing the width of slabs, in hot-rolled wide strip breaking-down trains in accordance with European patent application 0 400 385 A2 shown in FIG. 1 of the attached drawing, has on both sides tool carriers 2 which are arranged at the slab edge and receive pressing tools 1 which face toward each other. The reduction drive for each pressing tool is a lever system 4 which is actuated by a crank drive 3 and is movable essentially in direction of the reduction. The crank drive is arranged in a crank housing 5 which is arranged in a press frame 6 so as to be adjustable relative to the width of the slab. A feed drive 9 which operates essentially in direction of slab feeding direction 8 acts on the tool carrier which receives the pressing tool. The feed drive is constructed as a hydraulic piston-cylinder unit which is movable in accordance with a distance/time function and which facilitates the synchronization of the pressing tool with the moved slab in dependence on the desired feeding distance. In other words, the feeding distance of the pressing tools is adjusted in an optimum manner to the continuous travel speed of the slab through the press. If the preselection of the feeding speed is 0, the upsetting press automatically changes over to stop-and-go operation. In stop-and-go operation, no feeding takes place, i.e., the slab rests on the roller conveyor during the upsetting step. The slab is only conveyed further after the pressing tools have been moved away from the slab edge.

SUMMARY OF THE INVENTION

It is the object of the present invention to expand the operation of an upsetting press of the type described above. In particular, the production or the throughput of slabs to be upset is to be increased with simple means without having to increase the power of the main drive for the crank drive operating the pressing tools or the hydraulic feed drive for the tool carrier.

In accordance with the present invention, during the time phase in which the pressing tools have no contact with the slab edge, the slab is accelerated from the predetermined feeding speed and is subsequently again decelerated to this predetermined feeding speed, wherein previously upsetting of the slab may be reduced as necessary. The last step is carried out particularly when the maximum upsetting force would be exceeded in individual cases, for example, because of deformation resistance (material, temperature, slab thickness, etc.).

The steps of the method according to the present invention make it possible in a surprisingly simple manner to directly increase by up to 50% the throughput of the upsetting press or the production of upset slabs without having to change the existing construction of the upsetting press and without having to raise the power of the main drive of the eccentric lifting member, i.e., the crank drive, which serves to move the tool carriers including pressing tools, and without having to change the power of the piston-cylinder unit which acts on the tool carrier.

In accordance with a further development of the invention it is proposed that the slab is moved during the angle of rotation of approximately 0° to 180° of the eccentric lifting upsetting member at the predetermined feeding speed by means of drivable roller conveyor rollers and during the angle of rotation of approximately 180° to 360° the slab is accelerated by drive rollers and is again decelerated. It is advantageous if the slab is accelerated during the angle of rotation of approximately 180° to 360° of the eccentric lifting upsetting member to approximately twice to four times the predetermined feeding speed and is subsequently decelerated down to this predetermined feeding speed. In other words, following the upsetting phase during which the pressing tools make contact with the slab edge and are synchronized with the feeding speed of the slab, during the empty phase, i.e., the time phase during which the pressing tools have no contact with the slab edge, the slab is for a short period of time accelerated by means of the drive rollers to a high feeding speed and is immediately decelerated to the original feeding speed.

An upsetting press for laterally upsetting continuously cast slabs is known from German Offenlegungsschrift 25 31 591. In this upsetting press, the slab is repeatedly worked on by pressure tools which are moved toward each other and each tool is always placed against a certain location of the slab length and the tool can freely follow the continuous feeding of the slab. In this known upsetting press, the tools are moved in such a way that they carry out a relatively slow work step and a relatively fast empty step. Such an intermittent movement of the pressing tools is considered known and is used for making the throughput of the upsetting press flexible within certain limits. A significant slope-like increase of the throughput of an upsetting press cannot be achieved in this upsetting press unless the drive powers are increased accordingly.

In another slab upsetting press known from German Offenlegungsschrift 39 00 668, upsetting tools which are driven in opposite direction by eccentric shafts are arranged in pressing tool carriers which are guided slidably in a press frame. The press frame is divided into two press frame halves which are arranged symmetrically relative to the tool and which are connected to each other through four posts which extend parallel to each other in upsetting direction. Arranged on the posts are devices for the step-like feeding of the workpiece between the upsetting steps and for stopping the workpiece during the upsetting step. Accordingly, this upsetting press is to operate in a stop-and-go operation, wherein the feeding distance of the workpiece is adjustable by changing the piston strokes of the pressure medium cylinders of the devices for the step-like feeding of the tool. This German reference does not address features for increasing the throughput of the upsetting press without changing the drive power.

A completely different method of manufacturing a certain slab shape in an upsetting press is proposed in European patent 0 157 575. When the pressing tools of the upsetting press are located near the rearward end of the slab, the slab is moved ahead by inclined initial portions of the pressing tools in order to deform the rearward end of the slab; subsequently, the slab is pulled back and the remaining portion of the slab is pressed by the inclined initial portions of the pressing tool. This results in a type of tongue at the rearward end of the slab, the purpose of which is to avoid the fishtail-like portion at the rearward end of the slab. This European patent also does not discuss a production increase of the upsetting press.

In accordance with another European patent application 0 270 245 A2, an upsetting press is to manufacture in a stop-and-go operation a slab shape which has a tongue-like widened portion at the front end as well as at the rearward end. If the slab shaped in this manner is subsequently rolled in the hot rolling mill to hot-rolled strip, it should be possible to wind the beginning and the end of the strip directly onto a coil without requiring cropping which would lead to material loss. The European patent application does not disclose features for increasing the throughput of an upsetting press in a manner which is as simple as possible.

In accordance with another further development of the invention, for increasing the throughput of an upsetting press in a simple manner, it is proposed that during the first phase in which the crank angle of rotation is approximately 180° to 360° of the eccentric lifting upsetting member the slab travels within the same time unit a greater distance, preferably twice the distance, as compared to during the angle of rotation of up to 180° of the second phase.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
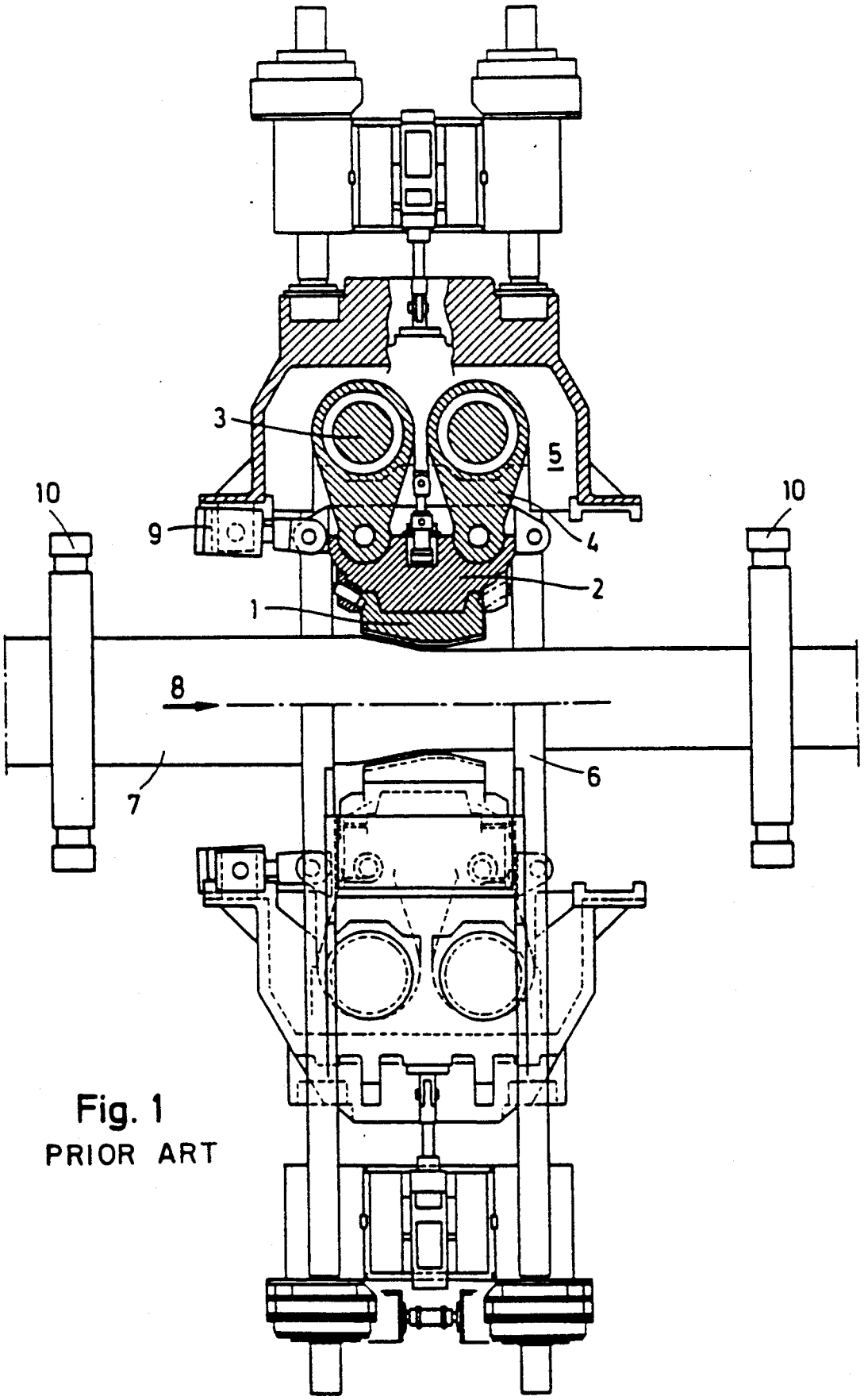
Fig. 1 PRIOR ART
FIG. 1 is a partially sectional view of a known upsetting press.

FIG. 1 of the drawing has been discussed hereinabove and shows a known upsetting press.

Figure 2:
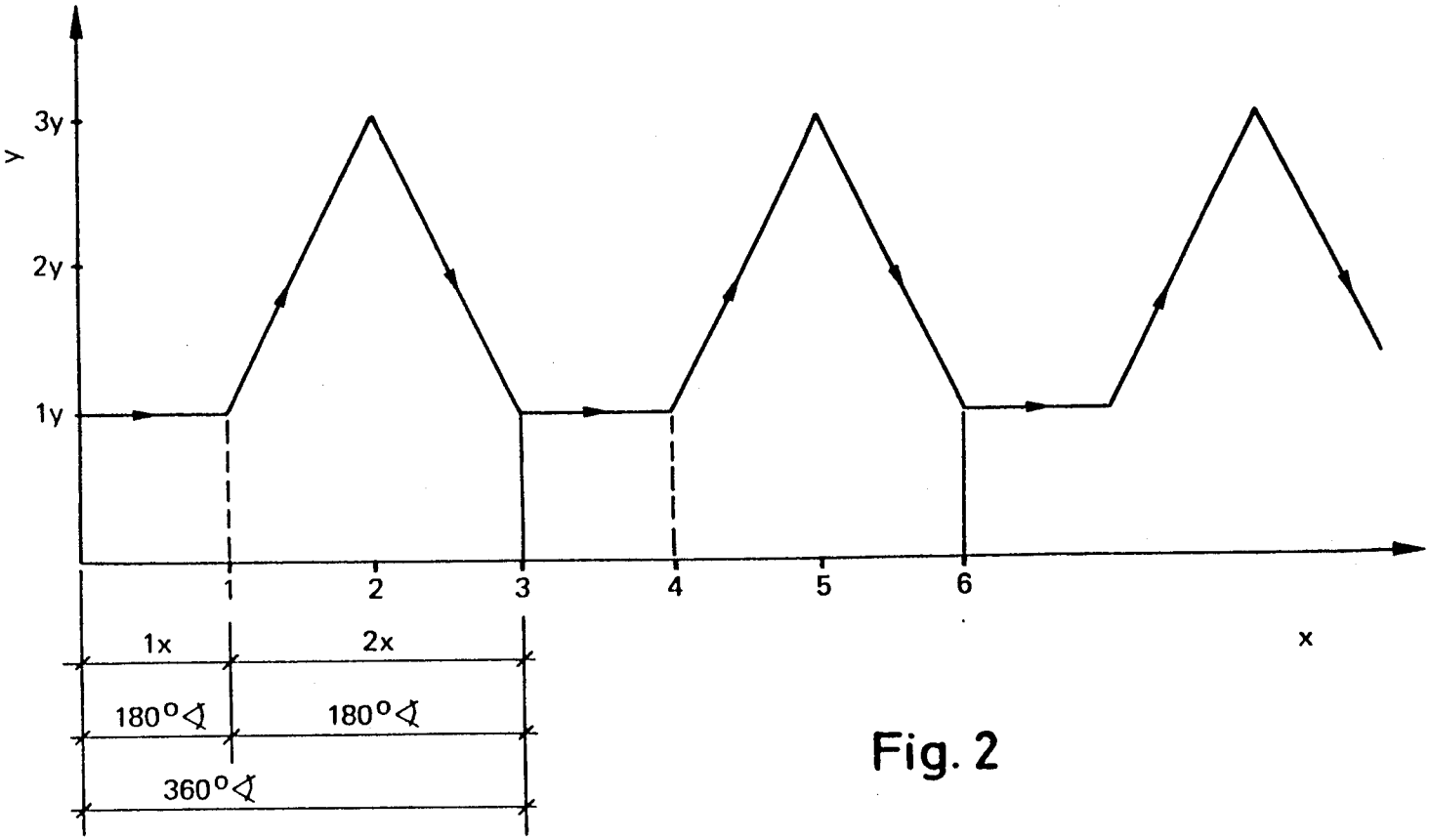
FIG. 2 is a diagram showing the feeding speed of a slab through the upsetting press.

In the diagram of FIG. 2, the feeding speed 8 of the slab is shown on the ordinate, relative to a 360° rotation of the eccentric lifting member of the crank drive which presses the pressing tools laterally against the slab edge and into the slab material.

In the first time phase in which the pressing tools are in contact with the slab, i.e., during an angle of rotation of approximately 90° within a rotation angle of 0° to 180° of the eccentric lifting member of the crank drive, the slab is conveyed with the predetermined feeding speed 1y on the roller conveyor of the upsetting press. Subsequently, in the second time phase in which the pressing tools have no contact with the slab edge, i.e., in the angle of rotation of approximately 180° to 360° of the eccentric lifting member of the crank drive, the slab is accelerated for a short period of time by means of drive rollers 10 shown in FIG. 1 to three times the feeding speed 3× and, after reaching the maximum speed, the slab is immediately decelerated until, at the end of the 360° angle of rotation, the originally predetermined feeding speed 1y of the slab is again reached. The distance traveled by the slab during this so-called "empty phase", i.e., the acceleration and deceleration phase, is approximately twice 2× the distance 1× traveled by the slab in the same time unit during the so-called "upsetting phase" during which the slab is upset by the pressing tools which are moved by the eccentric member of the crank drive.

Accordingly, if in accordance with the present invention the slab is accelerated from the predetermined feeding speed and again decelerated to the original feeding speed during the time phase in which the pressing tools have no contact with the slab edge, wherein previously upsetting of the slab may have been reduced, an immediate production increase can be achieved without having to carry out structural measures in the upsetting press and without having to increase the power of the main drive for the crank drive of the upsetting press or for the hydraulic feed drive thereof. The acceleration and deceleration of the slab during the so-called "empty phase" illustrated in the diagram of FIG. 2 can also assume a different pattern which may be optimized to the respectively existing operating conditions.

While a specific embodiment of the invention has been shown and described in detail to illustrate the application of the inventive principles, it will be understood that the invention may be embodied otherwise without departing from such principles.

I claim:

1. In a method of operating an upsetting press for reducing the width of a hot slab cast in a continuous casting plant by laterally pressing the slab between pressing tools of the upsetting press, the method including moving the pressing tools toward each other and away form each other by means of an eccentric lifting member as the slab is moving on a roller conveyor through the upsetting press, the improvement comprising, during a first time phase in which the pressing tools have no contact with the slab, accelerating the slab from a predetermined feeding speed and subsequently decelerating the slab to the predetermined feeding speed, and reducing the upsetting of the slab during a second time phase in which the pressing tools have contact with the slab prior to the acceleration of the slab.

2. The method according to claim 1, comprising moving the slab in the second phase during a crank drive angle of rotation of approximately 0° to 180° of the eccentric lifting member at the predetermined feeding speed by means of drivable roller conveyor rollers, and accelerating and decelerating the slab in the first phase by means of drive rollers during an angle of rotation of approximately 180° to 360° of the eccentric lifting member.

3. The method according to claim 1, wherein, during the first phase the crank drive angle is of approximately 180° to 360° of the eccentric lifting member, the slab is accelerated to two times to four times the predetermined feeding speed and is subsequently decelerated to the predetermined feeding speed.

4. The method according to claim 3, wherein, during the first phase when the crank drive angle of rotation of approximately 180° to 360° of the eccentric lifting member, the slab is moved by a greater distance than during the second phase of the crank drive of rotation of up to 180° of the eccentric lifting member.

5. The method according to claim 4, wherein the slab is moved by twice the distance than during the crank drive angle of rotation of up to 180° of the eccentric lifting member.

* * * * *

UNITED STATES PATENT AND TRADEMARK OFFICE

CERTIFICATE OF CORRECTION

PATENT NO. : 5,331,833

DATED : July 26, 1994

INVENTOR(S) : Gerhard Heitze

It is certified that error appears in the above-indentified patent and that said Letters Patent is hereby corrected as shown below:

On the title page item [22] should read:
--Filed: March 2, 1992--.

Signed and Sealed this

Twenty-seventh Day of September, 1994

*Attest:*

Bruce Lehman

BRUCE LEHMAN

*Attesting Officer*

*Commissioner of Patents and Trademarks*